US010246825B2

(12) United States Patent
Cohen et al.

(10) Patent No.: US 10,246,825 B2
(45) Date of Patent: Apr. 2, 2019

(54) SUPPORTING MECHANISM FOR A PAPERMAKING MACHINE DEWATERING BLADE

(71) Applicant: Andritz Inc., Glens Falls, NY (US)

(72) Inventors: David Cohen, Springfield, MA (US); Stephen Lamoureux, Springfield, MA (US)

(73) Assignee: Andritz Inc., Glens Falls, NY (US)

( * ) Notice: Subject to any disclaimer, the term of this patent is extended or adjusted under 35 U.S.C. 154(b) by 0 days.

(21) Appl. No.: 15/457,224

(22) Filed: Mar. 13, 2017

(65) Prior Publication Data

US 2017/0268172 A1 Sep. 21, 2017

Related U.S. Application Data

(60) Provisional application No. 62/309,519, filed on Mar. 17, 2016.

(51) Int. Cl.
*D21F 1/48* (2006.01)
*D21F 9/00* (2006.01)
*D21G 3/00* (2006.01)

(52) U.S. Cl.
CPC ..... *D21F 1/486* (2013.01); *D21F 9/003* (2013.01); *D21G 3/00* (2013.01)

(58) Field of Classification Search
CPC . D21F 1/483; D21F 1/486; D21F 1/20; D21F 9/003; D21G 3/00
See application file for complete search history.

(56) References Cited

U.S. PATENT DOCUMENTS 2,928,465 A 3/1960 Wrist
3,015,470 A 1/1962 Patchen
3,352,749 A * 11/1967 Perry ..... D21F 1/483 162/352
3,874,998 A 4/1975 Johnson
4,232,092 A * 11/1980 Goddard ..... D21F 1/483 108/161

(Continued)

FOREIGN PATENT DOCUMENTS

DE 10047841 4/2002
EP 0943729 A2 * 9/1999 ..... D21F 1/483

(Continued)

*Primary Examiner* — Jose A Fortuna
(74) *Attorney, Agent, or Firm* — Robert Joseph Hornung

(57) ABSTRACT

A pneumatically actuated doctoring device for paper machine de-watering/paper forming is provided having a base member supported on a papermaking machine structure, and a blade support with a fabric contact element. A single pneumatic air tube having first and second attachments on opposing sides is also provided. The first attachment engages the base member and the second attachment engages the blade support. The tube is configured for connection to a pressurized air source and a vacuum source to extend or retract the blade support. A linkage arrangement is connected between the blade support and the base member and includes first and second links located between the base member and the support member. The links each have a pivotal connection to the base member and provide for a fixed orientation of the blade support relative to the base member as the pneumatic air tube extends or retracts the blade support.

16 Claims, 5 Drawing Sheets

(56) References Cited

U.S. PATENT DOCUMENTS

| | | | | | |
|---|---|---|---|---|---|
| 5,061,347 | A | | 10/1991 | Bubik et al. | |
| 5,078,835 | A | | 1/1992 | Schiel et al. | |
| 5,169,500 | A | * | 12/1992 | Mejdell | D21F 1/486 162/352 |
| 5,262,010 | A | | 11/1993 | Bubik et al. | |
| 5,387,320 | A | | 2/1995 | Jaakkola | |
| 5,486,270 | A | * | 1/1996 | Schiel | D21F 1/486 162/352 |
| 5,660,689 | A | | 8/1997 | Bartelmuss et al. | |
| 6,039,843 | A | * | 3/2000 | Wight | D21F 1/483 162/352 |
| 6,372,093 | B1 | * | 4/2002 | Brewer | D21F 1/483 162/352 |
| 6,780,286 | B2 | | 8/2004 | Van Essen et al. | |
| 6,982,025 | B2 | * | 1/2006 | Pitt | D21F 1/483 118/413 |
| 2002/0060030 | A1 | | 5/2002 | Heinzmann | |
| 2004/0069431 | A1 | * | 4/2004 | Pitt | D21F 1/483 162/352 |
| 2004/0140077 | A1 | * | 7/2004 | Bricco | D21F 1/20 162/209 |
| 2007/0068644 | A1 | * | 3/2007 | Bricco | D21F 1/20 162/199 |
| 2014/0202648 | A1 | * | 7/2014 | Faufau | D21F 1/486 162/209 |
| 2016/0130754 | A1 | * | 5/2016 | House | D21F 1/486 162/352 |
| 2017/0268172 | A1 | * | 9/2017 | Cohen | D21F 1/486 |

FOREIGN PATENT DOCUMENTS

| | | | | | |
|---|---|---|---|---|---|
| EP | 0960974 | A2 | * | 12/1999 | D21F 1/483 |
| EP | 1215336 | | | 6/2002 | |
| EP | 1215336 | A2 | * | 6/2002 | D21F 1/486 |
| EP | 1215336 | A3 | * | 1/2003 | D21F 1/486 |
| EP | 1577437 | A1 | * | 9/2005 | D21F 1/483 |
| WO | WO-2017161077 | A1 | * | 9/2017 | D21F 1/483 |

* cited by examiner

SUPPORTING MECHANISM FOR A PAPERMAKING MACHINE DEWATERING BLADE

INCORPORATION BY REFERENCE

The following documents are incorporated herein by reference as if fully set forth: U.S. Provisional Patent Application No. 62/309,519, filed Mar. 17, 2016.

BACKGROUND

This invention concerns a fabric support element for use in a papermaking machine, and in particular a support mechanism for adjustably supporting a dewatering blade in a papermaking machine, or a forming section thereof.

In the manufacture of paper and board products, a highly aqueous stock consisting of about 98-99.8% water and from 0.2-2% papermaking fibers and other solids is ejected at high speed from a headbox slice onto a moving forming fabric. Adjacent the head box slice, the forming fabric passes in sliding contact over a plurality of static fabric support elements known as blades which serve to support the forming fabric, and to define a reference surface over which the forming fabric moves. Depending on the surface profile chosen for the fabric support elements, they may act as a doctoring device and assist in draining water from and generating turbulence in the stock on the forming fabric. The fabric support surfaces usually include a lead blade located more or less underneath the point at which the stock jet impinges the forming fabric, followed downstream by at least two additional blades, each of which may be flat, or profiled to act as foils (e.g. as disclosed by Wrist in U.S. Pat. No. 2,928,465) or as agitators (e.g. as disclosed by Johnson, in U.S. Pat. No. 3,874,998), although stock agitation is not typically initiated at this very early point in a forming section. The fabric contact elements, which are typically ceramic, are normally mounted onto a vertically adjustable supporting structure using either a dovetail or a T-bar support U.S. Pat. No. 6,780,286 to Van Essen et al. discloses an apparatus by which a paper maker can alter the number of fabric support elements in contact with the forming fabric in the area immediately after the stock impinges onto the forming fabric adjacent to the head box slice so as either to enhance, to maintain, or to diminish stock activity and thereby optimize agitation in accordance with papermaking conditions to provide a product of acceptable quality. Here, a contact element with a given profile can be vertically adjusted to be out of contact with the forming fabric and a support element with a different profile vertically adjusted to be in contact with the forming fabric.

A number patents show vertically adjustable support element mounting devices for use in papermaking machines. Typical structures are shown by: Bartelmuss et al in U.S. Pat. No. 5,660,689; Bubik et al. in U.S. Pat. No. 5,262,010 and U.S. Pat. No. 5,061,347; and Jaakkola U.S. Pat. No. 5,387,320.

FIGS. 1A-1C of the present application show some of the current designs for vertically adjustable support element mounting devices on the market. FIG. 1A shows a prior art blade support device 10*a* having a pneumatic air tube 12 located on a support member 20. The pneumatic air tube 12 contacts the bottom of a blade support 18 upon which the blade or doctoring element 16 is mounted. Slide control surfaces 14 are provided on the support member 20 to linearly guide the blade support 18 as it is extended upwardly by inflating the pneumatic air tube 12. FIG. 1B shows a similar arrangement of a prior art blade support device 10*b* in which the blade support 18 moves linearly upwardly along slide control surfaces 14. FIG. 1C shows a third blade support device 10*c* in which the blade support 18 is constrained for linear movement via slide control surfaces 14 on the support member 20 in order to move the doctoring element or blade 16 on the blade support 18 into or out of contact with a fabric surface. In this arrangement, two separate pneumatic air tubes 12*a*, 12*b* are provided with the first pneumatic air tube 12*a* being inflated in order to raise the blade and the second pneumatic air tube 12*b* being inflated in order to retract the blade from contact with the fabric.

These prior art arrangements rely on various methods of pneumatic retraction by a second actuator (tube 12*b*) or no positive retraction at all. All of these prior art devices also provide a linear movement using a linear guide mechanism wherein the support structure of the doctoring blade is constrained by a static bearing surface.

The current designs on the market rely on mating surfaces, which slide to control the movement of the doctoring element. This method inherently has excessive friction, which can increase if paper fibers from the slurry enter into these arrangements resulting in less controllability and loading sensitivity. Further, a complex system is required to provide for positive extension and retraction of the doctoring blade.

SUMMARY

It would be desirable to provide a blade support device which allows for positive extension and retraction of a doctoring element or a blade on a blade support which allows for simple operation and has lower friction than the known prior art arrangements. It would also be desirable to provide a pneumatically actuated doctoring device which is more cost effective than the prior known arrangements.

A pneumatically actuated doctoring device for paper machine de-watering/paper forming is provided. The device includes a base member that is adapted to be supported on a papermaking machine structure, and a blade support with a fabric contact element, which can be a doctoring element or blade. A single pneumatic air tube having first and second attachments on opposing sides of the pneumatic air tube is also provided. The first attachment engages the base member and the second attachment engages the blade support. The pneumatic air tube is configured for connection to a pressurized air source and a vacuum source to extend or retract the blade support relative to the base member. A linkage arrangement is connected between the blade support and the base member. The linkage arrangement includes at least first and second links that are located between the base member and the support member. The links each have a pivotal connection to the base member and provide for a fixed orientation of the blade support relative to the base member as the pneumatic air tube extends the blade support or retracts the blade support which is guided by the linkage arrangement.

In a preferred embodiment the linkage arrangement forms a four-bar linkage arrangement with each of the first and second links also having a pivotal connection to the blade support. Those skilled in the art will recognize that other linkage arrangements can be used. One particular benefit of a four-bar linkage arrangement is that this provides for constrained motion of the blade support relative to the base member in which the orientation of the blade support remains constant even as the blade moves along an arc-shaped path based on the guidance provided by the linkage arrangement.

In a preferred arrangement, the pivotal connections each include a pin that extends through the openings in the base member and the blade support. Optionally, the openings through which the pins extend may each include a bushing to provide for reduced friction.

Preferably, the distance between the pivotal connections of the first and second links on the base member is equal to a distance between the pivotal connections of the first and second links on the blade support such that the blade support orientation remains vertical as it moves between the extended and retracted positions.

Preferably, the pressurized air source and the vacuum source are connected to the single pneumatic air tube by a valve arrangement.

Optionally, at least one flexible cover is connected between the base member and the support member that encloses the linkage arrangement. This prevents the paper slurry from entering into the linkage arrangements.

In one preferred arrangement, the first and second attachments on the single pneumatic air tube have a T-shape and are integrally formed on opposing surfaces of the single pneumatic air tube. The base member and the blade support each include a corresponding T-shaped receptacle for a positive fit connection to the single pneumatic air tube.

In another aspect, a forming section of a papermaking machine is provided. This can be any type of forming section and can include twin wire formers, gap formers, as well as hybrid type formers. The forming section includes at least two rolls as well as a forming fabric that is supported on the at least two rolls. A t least one pneumatically actuated moveable doctoring device as discussed above is provided with one or more of the linkage arrangements as described above connected between the blade support and the base member which guides the blade support as it is extended or retracted into or out of contact with the forming fabric by the pneumatic air tube. Preferably a plurality of the pneumatically actuated moveable doctoring devices can be provided spaced apart from one another in a machine direction of the forming section. Each of the doctoring devices extends across a width of the forming fabric in the cross direction. Depending upon the particular characteristics of the paper being formed in the forming section of the papermaking machine, various ones of the pneumatically actuated moveable doctoring devices can be extended into contact with the forming fabric or be retracted out of contact with the forming fabric.

The linear motion of the doctoring element in the direction of the loading and minimizing friction of the doctoring element movement are critical components of the devices controllability. Providing for positive retraction of the doctoring element from the forming fabric is also beneficial to prevent the unintended loading of the doctoring element caused by diverted water forces. This arrangement has two critical advantages over the current state of art. First, the pneumatic air tube used for loading and unloading the doctoring element against the paper machine fabric has two attachment features on opposing sides of the tube, which act as attachment points. These attachment features allow for the single pneumatic air tube to couple together the base member of the counter blade and movable blade support with the doctoring element of the counter blade. The capability to couple the base and the doctoring element with the single air tube allows for the single pneumatic air tube to provide positive retraction when a vacuum is applied. Second, the doctoring element is connected to the counter blade base with a linkage arrangement which provides a very low friction method of controlling the movement of the doctoring element. The low friction is achieved through the linkage arrangement utilizing pin-bushing arrangements. As the doctoring element is loaded into the forming fabric, the four-bar linkage keeps the elements square to the fabric path, providing linear loading.

In another aspect, a pneumatically actuated moveable doctoring device for a paper machine forming section is provided having a base member adapted to be supported by a papermaking machine structure and a blade support with a fabric contact element. A pneumatic air tube having first and second attachments on opposing sides of the pneumatic air tube is provided, with the first attachment engaging the base member and the second attachment engaging the blade support. The pneumatic air tube is configured for connection to a pressurized air source and a vacuum source to extend or retract the blade support relative to the base member. The first and second attachments on the pneumatic air tube have an enlarged end section with a smaller base and are integrally formed on opposing surfaces of the single pneumatic air tube, and the base member and the blade support each include a corresponding undercut receptacle for a positive fit connection to the pneumatic air tube. A linkage arrangement is connected between the blade support and the base member. The linkage arrangement includes at least first and second links located between the base member and the blade support, with the links each having a pivotal connection to the base member and provide for a fixed orientation of the blade support relative to the base member as the pneumatic air tube extends the blade support or retracts the blade support guided by the linkage arrangement.

BRIEF DESCRIPTION OF THE DRAWINGS

The foregoing summary as well as the following detailed description will be better understood when reviewed in conjunction with the attached drawings which show a preferred arrangement. In the drawings.

DETAILED DESCRIPTION OF THE PREFERRED EMBODIMENTS

Figure 1A:
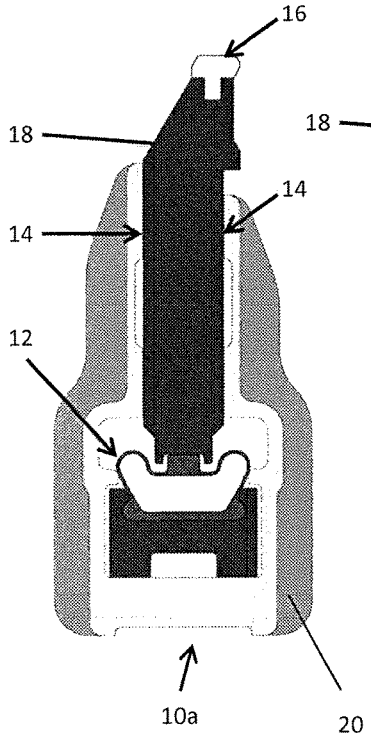
Figure 1A (Prior Art)
FIGS. 1A-1C show schematic illustrations of three known prior art arrangements.
Figure 1B:
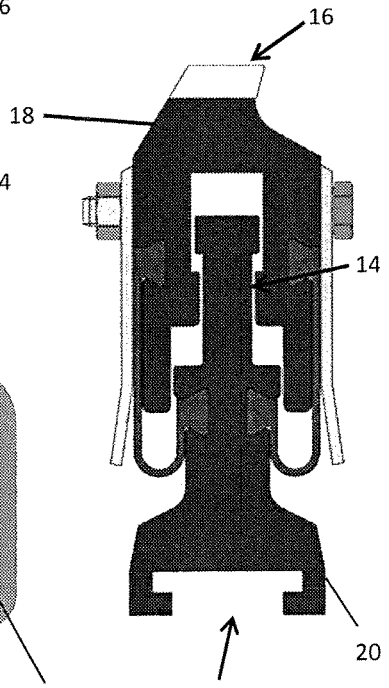
Figure 1B (Prior Art)

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. These terms and terms of similar import are for ease of description when referring to the drawings and should not be considered limiting.

"Machine Direction" refers to a direction in which a papermaking fabric travels in a papermaking machine. "Cross Direction" refers to a direction generally perpendicular to the Machine Direction. A reference to a list of items that are cited as "at least one of a, b, or c" (where a, b, and c represent the items being listed) means any single one of the items a, b, or c, or combinations thereof.

For elements of the invention that are identical or have identical actions, identical reference symbols are used. The illustrated embodiments represent merely examples for how the device according to the invention could be equipped. They do not represent a conclusive limitation of the invention.

Figure 1C:
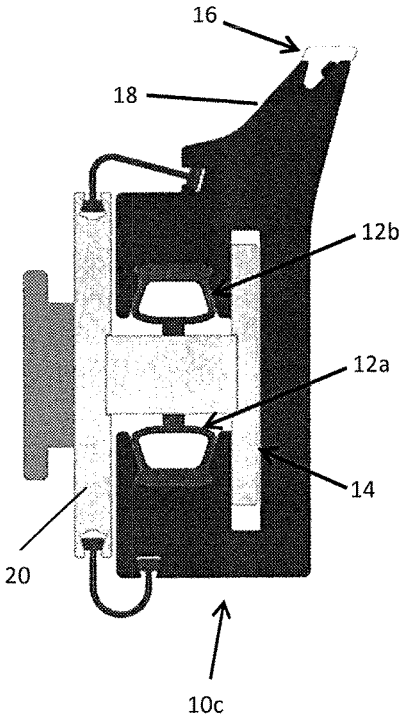
Figure 1C (Prior Art)
Figure 2:
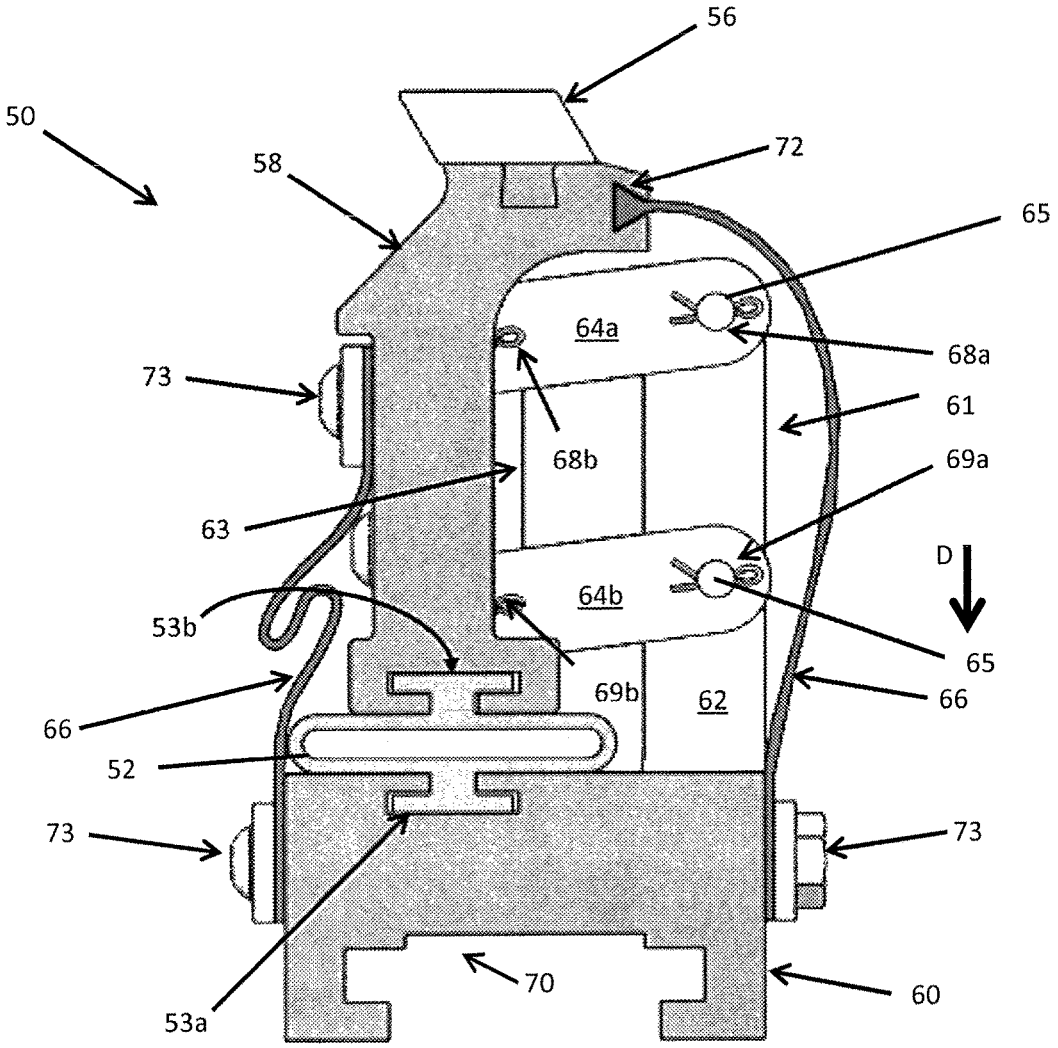
FIG. 2 shows a cross-sectional view of the present doctoring device in a configuration in which the pneumatic tube is not pressurized or has a vacuum applied so that the doctoring element is in a lowered position
Figure 3:
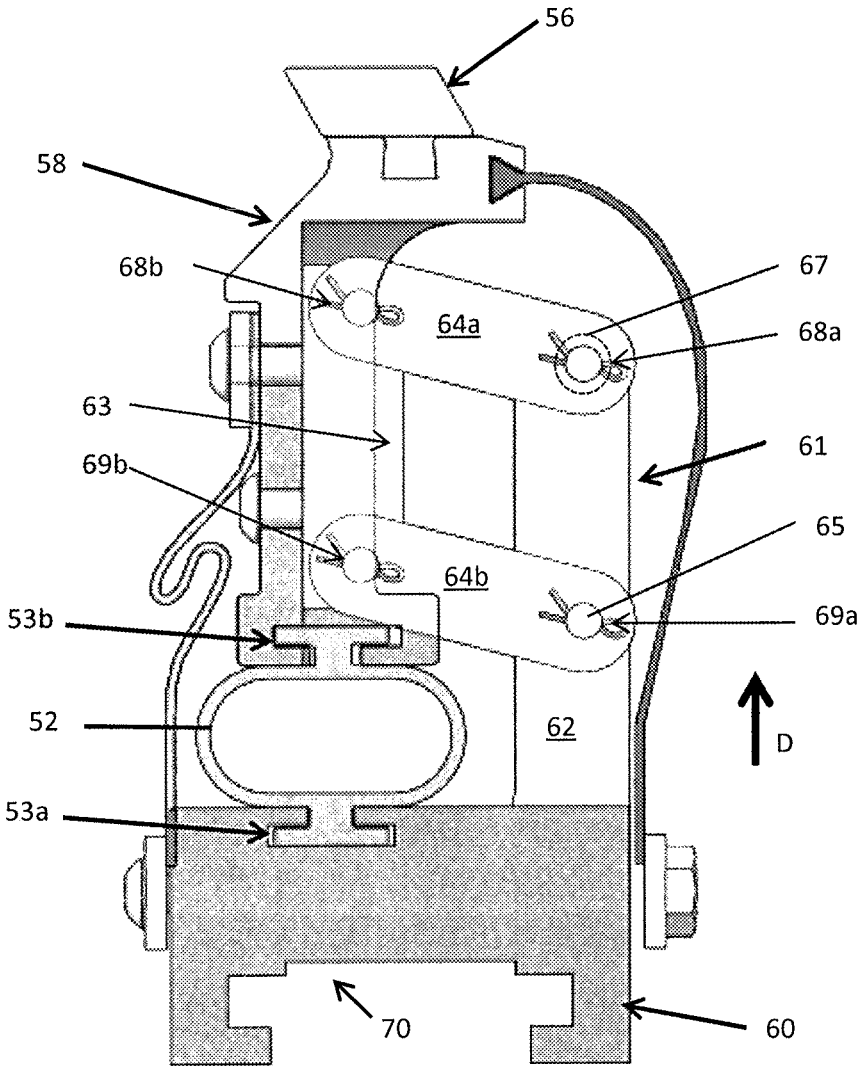
FIG. 3 shows the doctoring device of FIG. 2 with the pneumatic tube fully pressurized so that the doctoring element is in a raised position.
Figure 5:
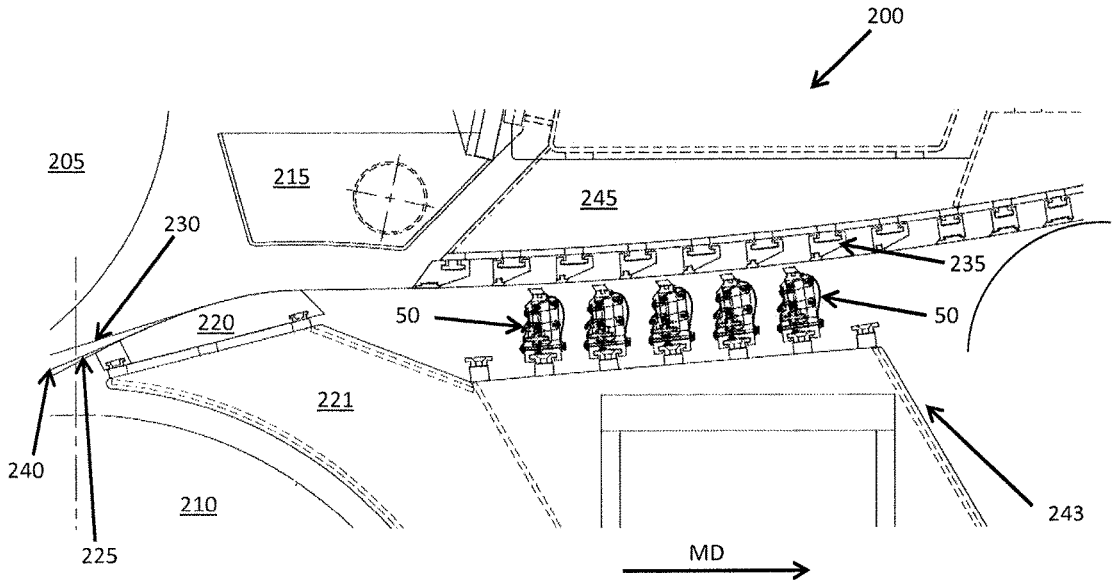
FIG. 5 is a partial view of a forming section of a papermaking machine with a plurality of the doctoring devices according to the invention arranged as counter blades.

Referring now to FIGS. 2 and 3, a pneumatically actuated moveable doctoring device 50 for a paper machine forming section (shown in FIG. 5) is shown. The doctoring device 50 includes a base member 60 which is adapted to be supported by a paper machine structure, for example as shown in FIG. 5. This can include, for example, a T-bar recess 70 for attachment to a paper machine support rail. While the base member 60 according to one embodiment of the doctoring device 50 is as shown in FIGS. 2 and 3, those skilled in the art will recognize that it could include a horizontal mounting arrangement, for example as shown in FIG. 1C according to the prior art.

A blade support 58 having a fabric contact element or doctoring element 56, formed for example from ceramic inserts is provided. The blade support 58 preferably includes a positive fit connection to the fabric contact element 56, which can be in the form of an undercut recess, such as a dove tail, to provide for positive engagement of the fabric contact element 56 to the blade support 58. Preferably, a single pneumatic air tube 52 having first and second attachments 53*a*, 53*b* on opposing sides of the pneumatic air tube 52 is provided, with the first attachment 53*a* engaging with the base member 60 and the second attachment 53*b* engaging with the blade support 58. The pneumatic air tube 52 has an inflatable chamber that can be pressurized or depressurized. In one preferred arrangement, the first and second attachments 53*a*, 53*b*, on the single pneumatic air tube 52 have an enlarged end section with a smaller base, preferably a T-shape, and are integrally formed on opposing surfaces of the single pneumatic air tube 52. The single pneumatic air tube 52 can be molded from rubber or a suitable elastomer with the integrally formed first and second attachments 53*a*, 53*b*. Alternatively, the first and second attachments can be other shapes, such as a dovetail which is adapted to engage in an undercut recess with a corresponding shape in the base member 60 and the blade support 58. Alternatively, other connectors, such as mechanical fasteners or an adhesive can be used to form the first and second attachments.

Figure 4:
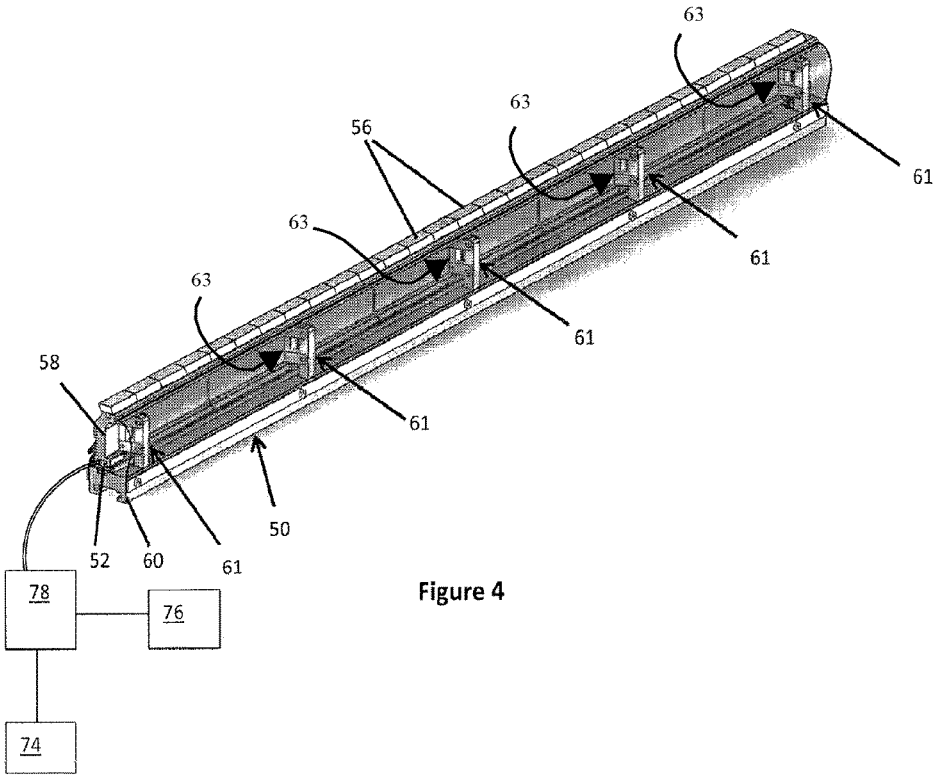
FIG. 4 is an illustration of a full-width dewatering blade comprising a plurality of doctoring devices.

The pneumatic air tube 52 is configured for connection to a pressurized air source 74, shown in FIG. 4, and to a vacuum source 76, also shown in FIG. 4, to extend or retract the blade support 58 relative to the base member 60. Preferably, the pressurized air source 74 and the vacuum source 76 are connected to the pneumatic air tube via a control valve 78. FIG. 2 shows the pneumatic air tube 52 with no pressurization and/or a vacuum applied in order to retract the blade support 58 relative to the base member 60 in the direction of travel D shown in FIG. 2, and FIG. 3 shows the single pneumatic air tube 52 connected to the pressurized air source 74 to inflate the single pneumatic air tube 52 and extend the blade support 58 in the direction of travel D shown in FIG. 3.

Still with reference to FIGS. 2 and 3, in order to guide the blade support 58 as it travels between the extended and retracted positions, a linkage arrangement 61 is connected between a blade support 58 and the base member 60. Preferably, a plurality of linkage arrangements 61 are connected between the blade support 58 and the base member 60, as shown in FIG. 4. The linkage arrangement 61 includes at least first and second links 64*a*, 64*b* located between the base member 60 and the blade support 58. The links 64*a*, 64*b* each have a pivotal connection indicated at 68*a* and 69*a* in FIG. 2 to the base member 60. Preferably, the linkage arrangement 61 forms a four-bar linkage arrangement with each of the first and second links 64*a*, 64*b* also having a pivotal connection to the blade support 58 indicated at 68*b* and 69*b*. In the arrangement shown in FIGS. 2-4, the base member 60 includes a first linkage upright 62, and the first and second links 64*a*, 64*b* are pivotally connected to the first linkage upright 62. As shown in FIG. 4, a plurality of the first linkage uprights 62 may be spaced in the cross direction along the base member 60 with pairs of the first and second links 64*a*, 64*b* being connected to each of the first linkage uprights 62 of the base member 60. The first linkage upright 62 may be provided as separate pieces that are connected to the base member 60 or they may be machined integrally with the base member 60. Depending upon the configuration of the base member 60, the first linkage uprights 62 can be omitted and the pivotal connections 68*a*, 69*a* can be made directly to the main body of the base member 60.

As shown in FIG. 2, a second linkage upright 63 may be provided as part of the blade support 58. The first and second link 64*a*, 64*b* are preferably also connected via pivotal connections 68*b*, 69*b* to the blade support 60 on the second linkage upright 63. The second linkage upright 63 can be provided as a separately formed part that is attached to the blade support 58 or may be integrally formed or machined on the blade support 58. As shown in FIG. 4, preferably a plurality of the second linkage upright 63 are also provided spaced apart in the cross direction on the blade support 58 in corresponding positions to the first linkage upright 62 at the location of each linkage arrangement 61.

The pivotal connections 68*a*, 68*b*, 69*a*, 69*b* preferably each include a pin 65 that extends through openings in the base member 60 and the blade support 58. The openings may include a bushing therein (an exemplary one of which is indicated in broken lines at 67 in FIG. 3) and the pin 65 would then extend through such bushings 67. The bushings 67 may be made from a self-lubricating material.

As shown in FIGS. 2 and 3, a distance between the pivotal connections on the base member 60 is equal to a distance between the pivotal connections on the blade support 58 in the preferred four-bar mechanism formed by the linkage arrangement 61. This arrangement provides that the orientation of the blade support 58 along with the doctoring element 56 located thereon remains generally fixed with respect to horizontal and vertical, even as the blade support 58 travels along an arcuate path defined by the linkage arrangement 61 as the pneumatic air tube is pressurized or depressurized to extend or retract the blade support 58. The amount of travel in the Machine Direction of the blade support 58 as the blade support 58 is extended or retracted due to the application of pressure or vacuum to the single pneumatic air tube 52 is small relative to the vertical travel in the direction of travel D of the blade support 58 relative to the base member 60. The applicants have found that this minimal amount of travel in the Machine Direction can be compensated for in the mounting arrangement of the base member 60 to the papermaking machine forming section 200 shown in FIG. 5, and that the MD offset is de minimis.

Those skilled in the art will recognize that various other linkage arrangements can be provided other than a four-bar mechanism to achieve a similar travel path while maintaining a generally fixed orientation of the blade support 58 relative to the base member 60 in both the horizontal and vertical directions.

As shown in FIGS. 2 and 3, at least one flexible cover 66 can be attached between the base member 60 and the blade support 58. In a preferred embodiment, two flexible covers 66 are shown with either screw attachments 73 or a keyed attachment feature, such as dove tail slot indicated at 72 in FIG. 2. Those skilled in the art will recognize that the flexible cover 66 can be omitted, if desired, allowing the linkage arrangements 61 to be exposed to the papermaking slurry. In this case, the pivotal connections 68*a*, 68*b*; 69*a*, 69*b* for the first and second links 64*a*, 64*b* can be sealed or otherwise protected to prevent higher friction due to paper fibers becoming trapped in the pivotal connections.

Referring now to FIGS. 4 and 5, as shown in FIG. 4 the doctoring device 50 preferably extends across a forming section 200 of a papermaking machine, shown in FIG. 5. The doctoring elements or blades 56 connected to the blade support 58 are preferably provided in segments and made of a ceramic material. While a total of five linkage arrangements 61 are shown connected between the base member 60 and the blade support 58, those skilled in the art will recognize that a different number of linkage arrangements 61 could be utilized.

As shown in FIG. 5, the forming section 200 of the papermaking machine includes a forming roll 205 and a breast roll 210, and preferably an autoslice 215. Stock, indicated at 240 is delivered onto a forming fabric 225 in a position on an impingement (forming) shoe 220, preferably mounted on a support unit 221. A backing fabric 230 travels over the forming fabric 225, and the fabrics 225, 230 carry the stock between fixed blades 235 and counterblades, which in the present case are provided as the pneumatically actuated moveable doctoring devices 50 as described above in order to remove water from the stock and form a nascent paper web. These pneumatically actuated moveable doctoring devices 50 are preferably located on a counterblade support unit 243, and the opposing fixed blades 235 are located on a fixed blade support unit 245.

The pneumatically actuated moveable doctoring devices 50 can be individually moved into or out of contact with the forming fabric 225 by extending the blade support 58 relative to the base member 60 by pressurizing the pneumatic air tube 52 or retracting the blade support 58 out of contact from the forming fabric 104 by depressurizing and/or applying a vacuum to the pneumatic air tube 52 in the particular doctoring device 50 depending upon the particular properties being achieved by the specific placement of the doctoring elements or blades 56, acting as counter blades in the embodiment of FIG. 5, contacting the forming fabric 225.

The present invention provides the advantage of a single pneumatic air tube 52 that can be used for both loading and unloading the doctoring element 56 of a particular doctoring device 50 based on the two attachments providing on opposing sides of the tube 52. Further, the linkage arrangements 61 of each of the doctoring devices 50 allows for a low friction moveable arrangement that maintains the orientation of the blade support 58 along with its doctoring element or blade element 56 as it is moved into contact with the forming fabric 225 while avoiding the issues associated with a sliding support of the prior art. The low friction linkage arrangements 61 along with the single pneumatic tube 52 for each of the doctoring devices 50 thus provide a simple system with lower cost that provides for both positive extension and retraction.

While a single pneumatic air tube 52 is preferred, it is within the scope of the present invention to have two pneumatic air tubes arranged side-by-side with both having positive attachments to the base member 60 and the blade support 58, and this still being considered functionally as a single pneumatic air tube as described herein.

Having thus described the present invention in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

LIST OF ELEMENT NUMBERS

10*a*, 10*b*, 10*c*—Prior art blade support devices
12—pneumatic air tube
14—sliding control surfaces
16—doctoring element
18—blade supporting means
20—base member
50—doctoring device
52—pneumatic air tube
53*a*, 53*b*—T-shaped attachment means for pneumatic air tube 12
56—doctoring element
58—blade support
60—base member
61—linkage arrangement
62—first linkage upright
63—second linkage upright
64*a*, 64*b*—links
65—pin
66—flexible cover
67—bushing
68*a,b*—first link pin-bushing arrangements
69*a,b*—second link pin-bushing arrangements
70—T-bar recess (for attachment to paper machine support rail)
72, 73—attachments for shroud to doctoring device
74—pressurized air source
76—vacuum source
78—valve
200—twin wire forming section in a papermaking machine
205—forming roll
210—breast roll
215—autoslice
220—impingement (forming) shoe
221—support unit for impingement shoe 220
225—conveying fabric
230—backing fabric
235—opposing fixed blade

240—stock jet
243—counterblade support unit
245—fixed blade support unit
D—direction of movement (due to inflation and deflation of pneumatic tube 52)
MD—machine direction

The invention claimed is:

1. A pneumatically actuated moveable doctoring device for a paper machine forming section, the device comprising:
a base member adapted to be supported by a papermaking machine structure;
a blade support with a fabric contact element;
a single pneumatic air tube having first and second attachments on opposing sides of the pneumatic air tube, the first attachment engages the base member and the second attachment engages the blade support, the pneumatic air tube being configured for connection to a pressurized air source and a vacuum source to extend or retract the blade support relative to the base member; and
a linkage arrangement connected between the blade support and the base member, the linkage arrangement including at least first and second links located between the base member and the blade support, the links each having a pivotal connection to the base member and provide for a fixed orientation of the blade support relative to the base member as the pneumatic air tube extends the blade support or retracts the blade support guided by the linkage arrangement.

2. The doctoring device of claim 1, wherein the linkage arrangement forms a four-bar linkage arrangement, with each of the first and second links having a pivotal connection to the blade support.

3. The doctoring device of claim 2, wherein the pivotal connections each include a pin that extends through openings in the base member and the blade support.

4. The doctoring device of claim 3, wherein the openings each include a bushing therein, and the pins extend through the bushings.

5. The doctoring device of claim 2, wherein a distance between the pivotal connections of the base member is equal to a distance between the pivotal connections on the base support.

6. The doctoring device of claim 1, further comprising the pressurized air source and the vacuum source connected to the single pneumatic air tube by a valve arrangement.

7. The doctoring device of claim 1; further comprising a least one flexible cover connected between the base member and the blade support that encloses the linkage arrangement.

8. The doctoring device of claim 1, wherein the first and second attachments on the single pneumatic air tube have a T-shape and are integrally formed on the opposing sides of the single pneumatic air tube, and the base member and the blade support each include a corresponding T-shaped receptacle for a positive fit connection to the single pneumatic air tube.

9. The doctoring device of claim 1, wherein the fabric contact element is connected to the blade support with a positive fit connection.

10. A forming section of a papermaking machine, comprising:
at least two rolls;
a forming fabric that is supported on the at least two rolls; and
a pneumatically actuated moveable doctoring device, including
a base member adapted to be supported by a papermaking machine structure;
a blade support with a fabric contact element that extends in a cross direction across a width of the fabric;
a single pneumatic air tube having first and second attachments on opposing sides of the pneumatic air tube, the first attachment engages the base member and the second attachment engages the blade support, the pneumatic air tube being configured for connection to a pressurized air source and a vacuum source to extend or retract the blade support relative to the base member into and out of contact with the forming fabric; and
a linkage arrangement connected between the blade support and the base member, the linkage arrangement including at least first and second links located between the base member and the support member, the links each have a pivotal connection to the base member and provide for a fixed orientation of the blade support relative to the base member as the pneumatic air tube extends the blade support into contact with the forming fabric or retracts the blade support guided by the linkage arrangement.

11. The forming section of claim 10, further comprising at least a second one of the pneumatically actuated moveable doctoring devices.

12. The forming section of claim 10, wherein the linkage arrangement forms a four-bar linkage arrangement, with each of the first and second links having a pivotal connection to the blade support.

13. The forming section of claim 10, wherein the pivotal connections each include a pin that extends through openings in the base member and the blade support.

14. The forming section of claim 10, further comprising additional linkage arrangements that are spaced apart from one another in the cross direction.

15. The forming section of claim 10, wherein the base member includes an undercut recess for connection to a frame of the forming section.

16. A pneumatically actuated moveable doctoring device for a paper machine forming section, the device comprising:
a base member adapted to be supported by a papermaking machine structure;
a blade support with a fabric contact element;
a pneumatic air tube having first and second attachments on opposing sides of the pneumatic air tube, the first attachment engages the base member and the second attachment engages the blade support, the pneumatic air tube being configured for connection to a pressurized air source and a vacuum source to extend or retract the blade support relative to the base member, the first and second attachments on the pneumatic air tube have an enlarged end section with a smaller base and are integrally formed on opposing surfaces of the pneumatic air tube, and the base member and the blade support each include a corresponding undercut receptacle for a positive fit connection to the pneumatic air tube; and
a linkage arrangement connected between the blade support and the base member, the linkage arrangement including at least first and second links located between the base member and the blade support, the links each have a pivotal connection to the base member and provide for a fixed orientation of the blade support relative to the base member as the pneumatic air tube extends the blade support or retracts the blade support guided by the linkage arrangement.

* * * * *